US006023014A

United States Patent [19]

Sperzel

[11] Patent Number: 6,023,014

[45] Date of Patent: Feb. 8, 2000

[54] APPARATUS FOR CHANGING THE TENSION IN A STRING OF A MUSICAL INSTRUMENT

[76] Inventor: Robert J. Sperzel, 12520 Edgewater Dr., Lakewood, Ohio 44107

[21] Appl. No.: 09/160,083

[22] Filed: Sep. 24, 1998

[51] Int. Cl.[7] ..... G10D 3/14

[52] U.S. Cl. ..... 84/306; 84/312 R

[58] Field of Search ..... 84/304–306, 312 R, 84/312 P, 313

[56] References Cited

U.S. PATENT DOCUMENTS

| | | | |
|---|---|---|---|
| 2,771,808 | 11/1956 | Jenkins, Jr. . | |
| 3,431,807 | 3/1969 | Thompson . | |
| 3,452,635 | 7/1969 | Sebers et al. . | |
| 3,674,909 | 7/1972 | Peters, Jr. et al. . | |
| 3,769,871 | 11/1973 | Cawthorn . | |
| 4,147,087 | 4/1979 | Peters, Jr. et al. . | |
| 4,191,086 | 3/1980 | Spercel | 84/306 |
| 4,329,904 | 5/1982 | Monteleone | 84/306 |
| 4,353,280 | 10/1982 | Spercel . | |
| 4,528,887 | 7/1985 | Frederick | 84/306 |
| 4,625,614 | 12/1986 | Spercel . | |
| 4,643,069 | 2/1987 | Borisoff et al. . | |
| 4,735,124 | 4/1988 | Bernier . | |
| 5,537,144 | 7/1996 | Sherman . | |
| 5,728,955 | 3/1998 | Sperzel . | |
| 5,767,427 | 6/1998 | Corso | 84/306 |

FOREIGN PATENT DOCUMENTS 340568 of 1921 Germany .

*Primary Examiner*—Stanley J. Witkowski
*Attorney, Agent, or Firm*—Tarolli, Sundheim, Covell, Tummino & Szabo L.L.P.

[57] ABSTRACT

A musical instrument has a plurality of strings connected with string posts having central axes disposed in a single plane which extends perpendicular to opposite sides of a head portion of the musical instrument. A string tuning device is connected with each of the strings. The string tuning device is operable to tension the string of a musical instrument to obtain a predetermined initial tension or pitch. A plurality of detuning actuators are provided in association with the tuning devices. The detuning actuators are manually operable to change the tension in a string of the musical instrument from the initial tension by a predetermined amount. Each of the tuning devices includes a worm which is disposed in meshing engagement with a pinion connected with a string post. The detuning actuator is connected with one end of the worm by a coupling which allows the worm to be rotated relative to the detuning actuator during the obtaining of the predetermined tension in the string. Upon manual operation of the detuning actuator, force is transmitted from the detuning actuator to the coupling to rotate the worm and change the tension in the string.

44 Claims, 7 Drawing Sheets

16
48
52
74
66
70
66
70
74
46
52
84
44
90
74
70
66
66
70
74
82
52
42
74
40
66
74
70
66
52
70
88
38
52
36
56
34
14

18
24
20
26
22
28

APPARATUS FOR CHANGING THE TENSION IN A STRING OF A MUSICAL INSTRUMENT

BACKGROUND OF THE INVENTION

The present invention relates to a new and improved musical instrument and more specifically to a musical instrument of the guitar or banjo type.

Musical instruments of the guitar or banjo type have tuning devices to vary the tension in the strings of the musical instrument. It has previously been suggested that a device be provided to enable the tension in one or more of the strings of the musical instrument to be changed by a predetermined amount from a selected initial tension. By changing the tension of the string from the initial tension, special effects can be obtained during the playing of the musical instrument. Devices for use in changing the tension in a string of a musical instrument are disclosed in U.S. Pat. Nos. 3,674,909; 4,147,087; and 4,643,069.

SUMMARY OF THE INVENTION

The present invention provides a new and improved musical instrument having an improved apparatus for use in tensioning a string and for changing the tension in the string by a predetermined amount. The apparatus includes a tuning device for tensioning the string. The tuning device includes a string post and a pinion which is connected with the string post. A worm is disposed in meshing engagement with the pinion. A manually rotatable knob is connected with one end portion of the worm. Rotation of the knob rotates the worm and imparts rotary motion to the pinion and string post to obtain a desired initial tension in the string of the musical instrument.

A detuning actuator is connected with the worm. The detuning actuator is operable to rotate the worm through a predetermined distance to change the tension in the string of the musical instrument from the initial tension by a predetermined amount. A coupling may be used to interconnect the worm and the detuning actuator to enable the worm to rotate relative to the detuning actuator to obtain a first tension in the string. The coupling is effective to transmit force from the detuning actuator to the worm to change the tension in the string of the musical instrument from the initial tension to a second tension.

The head portion of the musical instrument may have a linear edge portion and a nonlinear edge portion. Some of the tuning devices have manually rotatable knobs disposed adjacent to the linear edge portion. Other tuning devices have manually rotatable knobs disposed adjacent to the nonlinear edge portion. One or more detuning actuators are mounted on the head portion between the linear and nonlinear edge portions.

BRIEF DESCRIPTION OF THE DRAWINGS

The foregoing and other features of the invention will become more apparent upon a consideration of the following description taken in connection with the accompanying drawings wherein.

DESCRIPTION OF SPECIFIC PREFERRED EMBODIMENTS OF THE INVENTION

GENERAL DESCRIPTION

Figure 1:
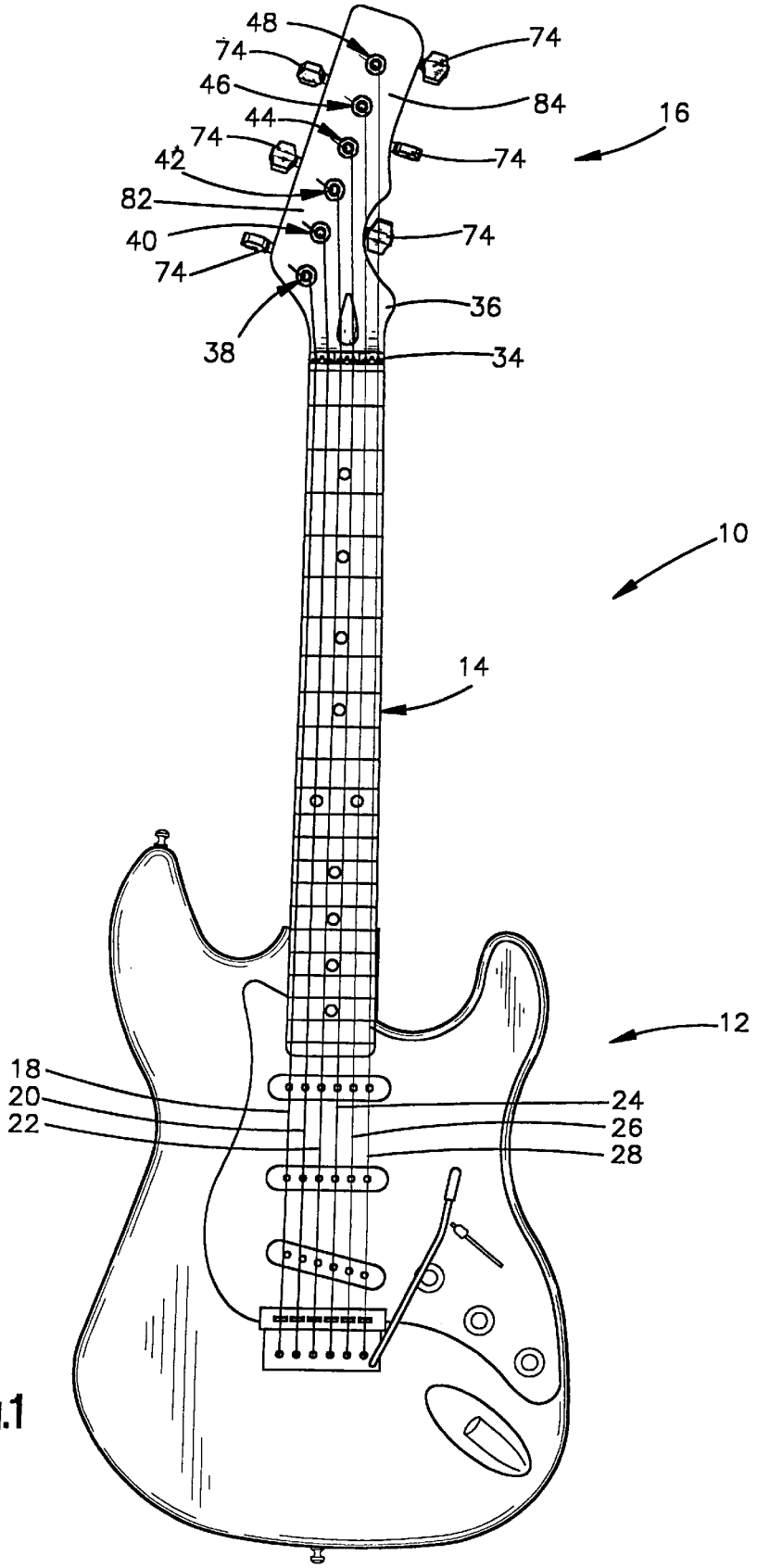
FIG. 1 is a front elevational view of a musical instrument having tuning devices and detuning actuators constructed in accordance with the present invention.

A musical instrument 10 (FIG. 1) includes a body portion 12 having a well known construction. A neck portion 14 extends outward from the body portion 12 to a head portion 16. A plurality of strings 18, 20, 22, 24, 26 and 28 extend from the body portion 12 along the neck portion 14 to the head portion 16.

The strings 18–28 are straight and parallel to each other along the neck portion 14. They extend from the neck portion 14 across a string support 34 to the head portion 16. At the string support 34, the strings are deflected toward a flat front side surface 36 (FIG. 2) on the head portion 16. The string support 34 has the same construction as is disclosed in U.S. Pat. No. 5,492,044 issued Feb. 20, 1996 and entitled "String Support Having a Base With String Support Members and Method".

Figures 2, 6:
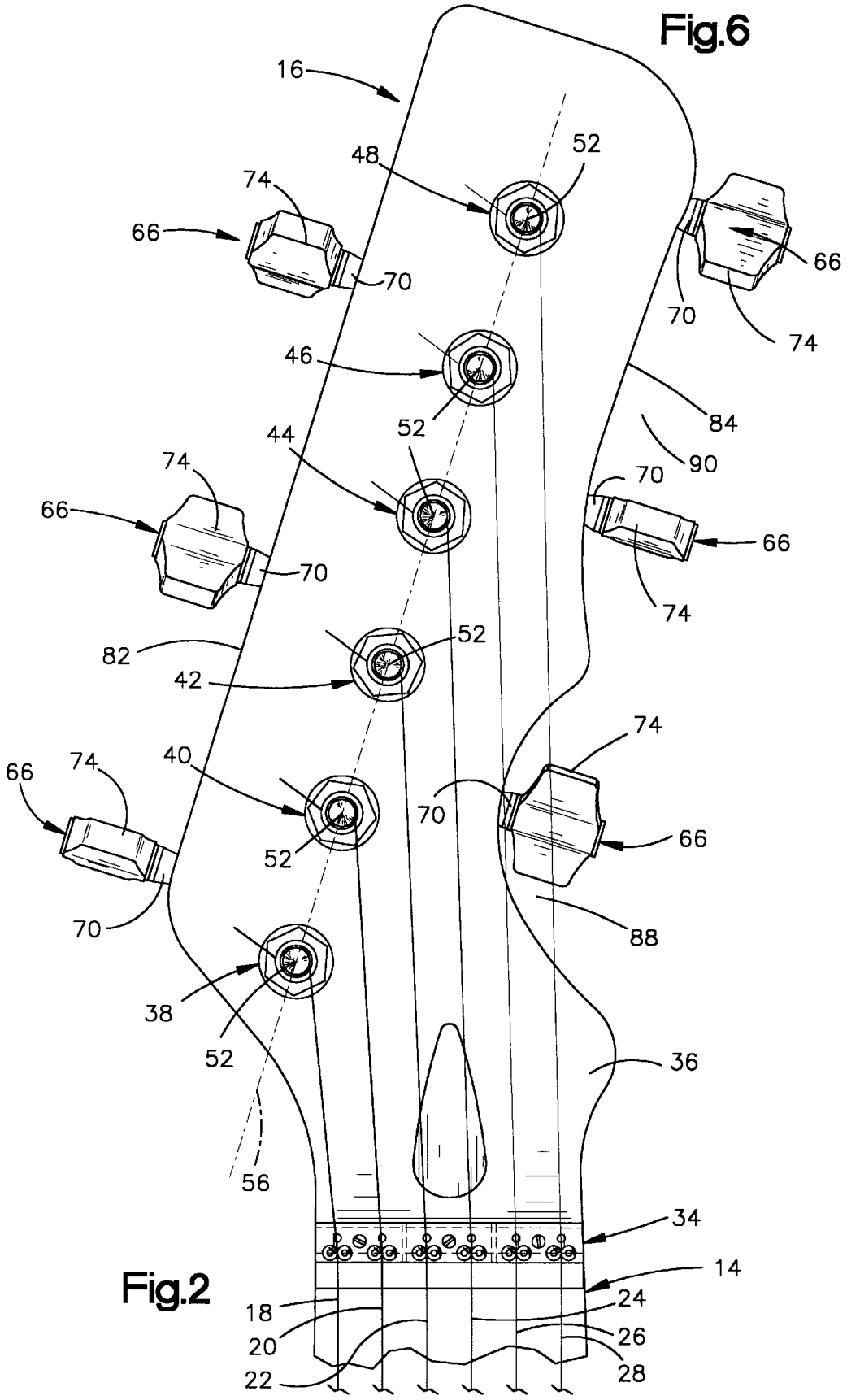
FIG. 2 is an enlarged view of a head portion of the musical instrument of FIG. 1 and illustrating the relationship of a plurality of tuning devices to the head portion.
FIG. 6 is a fragmentary end view, taken generally along the line 6—6 of FIG. 5, further illustrating the detuning actuator.

At the head portion 16, each of the strings 18–28 is connected with a tuning device of a plurality of tuning devices mounted on the head portion 16. Thus, the string 18 is connected with a tuning device 38 (FIG. 2). The string 20 is connected with a tuning device 40. The string 22 is connected with a tuning device 42. Similarly, the string 24 is connected with a tuning device 44. The string 26 is connected with a tuning device 46. The string 28 is connected with a tuning device 48.

Figure 3:
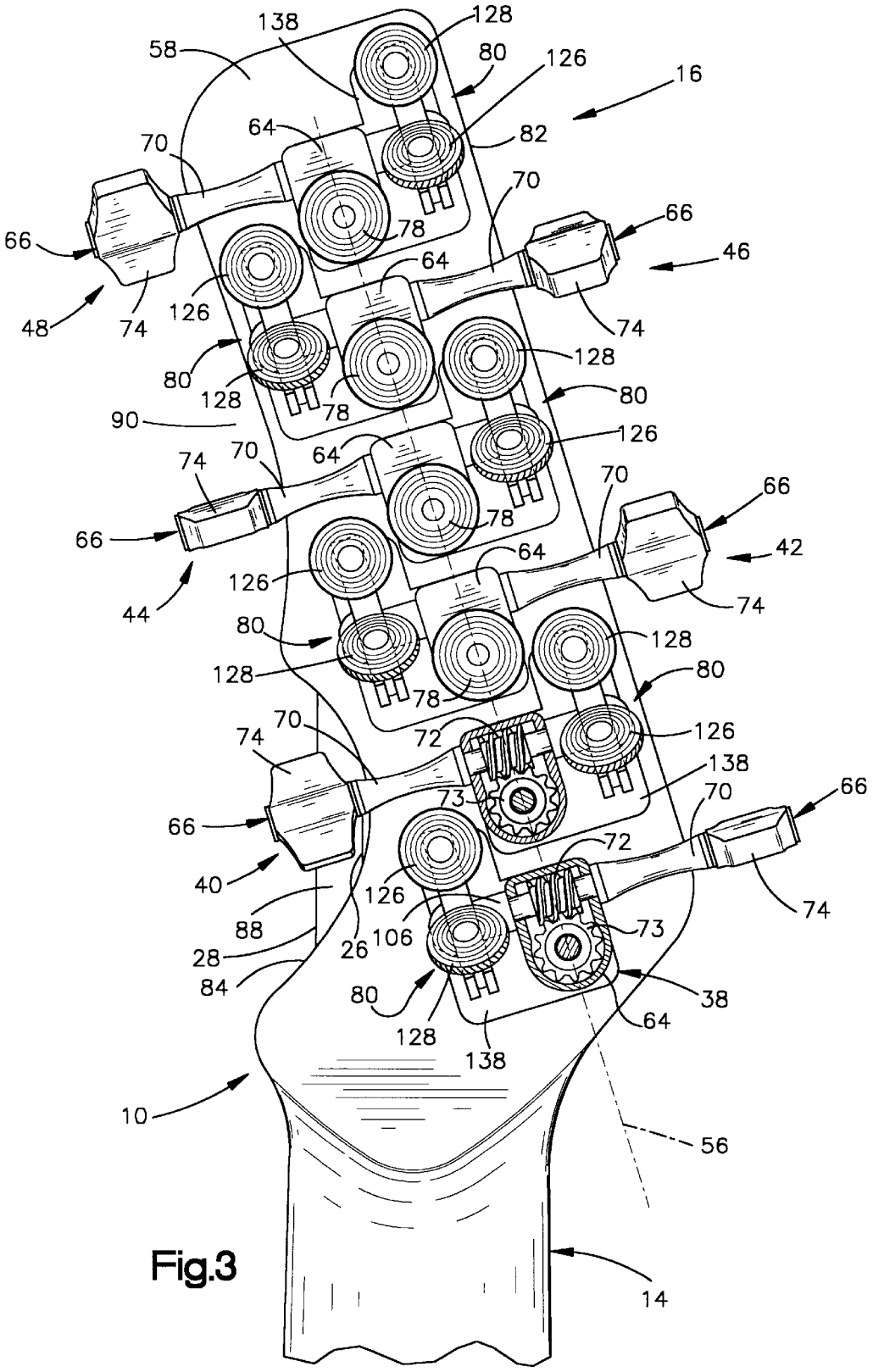
FIG. 3 is a partially broken away rear elevational view illustrating the relationship of tuning devices and detuning actuators to the head portion of the musical instrument of FIG. 1.
Figure 4:
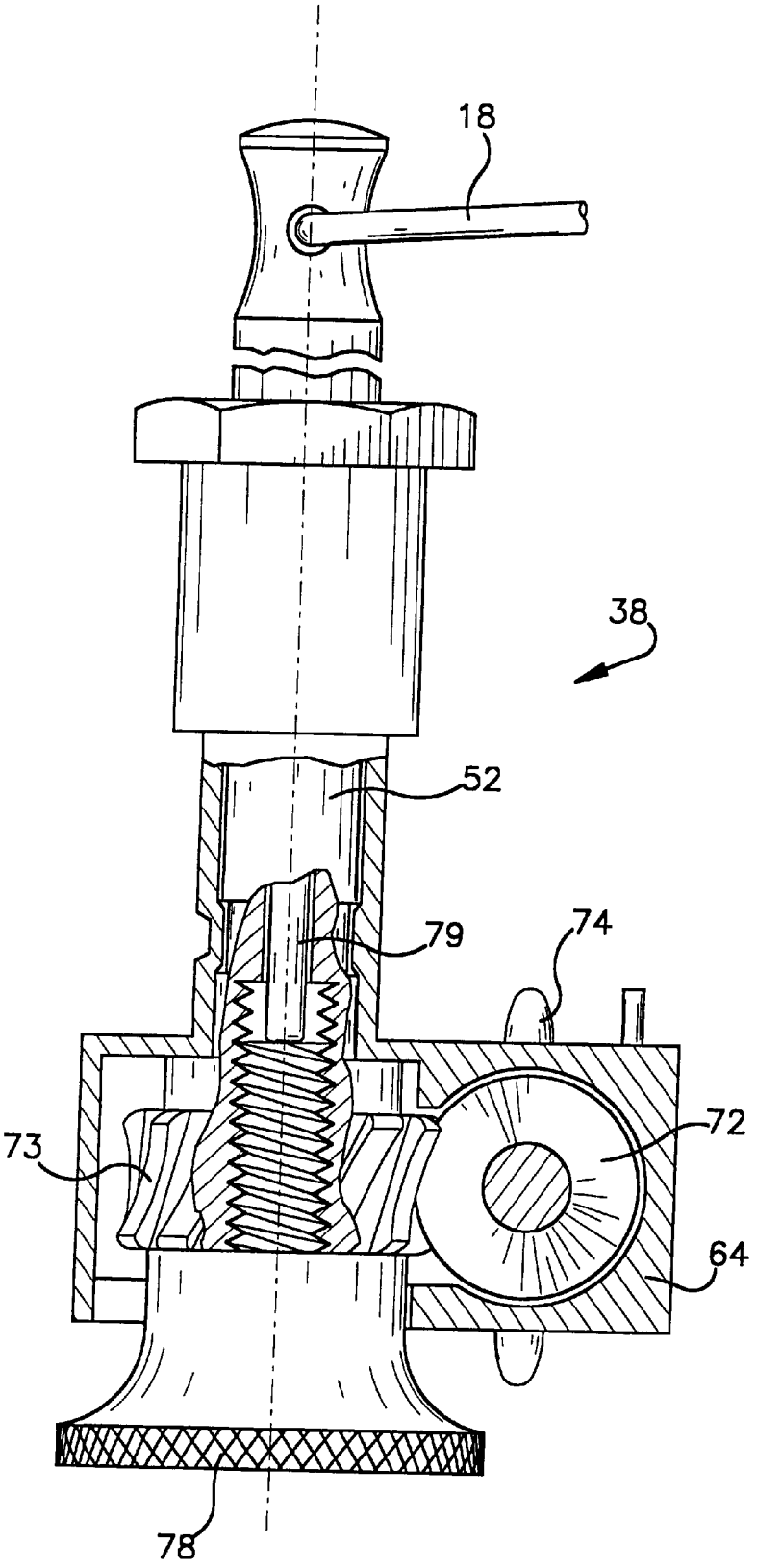
FIG. 4 is an enlarged fragmentary sectional view of a tuning device.

Each of the tuning devices 38–48 includes a generally cylindrical string post 52 (FIGS. 2 and 4). The string posts 52 extend through the head portion 16 of the musical instrument 10. The string posts 52 have parallel central axes disposed in a linear array. The central axis of each of the string posts 52 is disposed in a plane 56 (FIG. 2). The plane 56 extends perpendicular to parallel front and rear side surfaces 36 and 58 (FIGS. 2 and 3) of the head portion 16.

The parallel central axes of the string posts 52 extend perpendicular to parallel front and rear side surfaces 36 and 58 of the head portion 16. The string posts 52 are spaced equal distances apart in a linear array on the head portion 16 of the musical instrument 10. The string posts 52 are aligned with connections of the strings 18–28 with the body portion 12 (FIG. 1) of the musical instrument 10. Therefore, the strings 18–28 are disposed in parallel planes. By having the strings 18–28 disposed in parallel planes, tensioning of the strings by operation of the tuning devices 38–48 is facilitated.

Each of the tuning devices 38–48 includes a housing 64 (FIG. 3). In addition, each of the tuning devices 38–48 includes a main actuator 66. The main actuators 66 are manually rotatable to rotate the string posts 52 about their central axes to adjust tension in the strings 18–28.

Each of the main actuators 66 includes a shaft 70. Each of the shafts 70 is integrally formed as one piece with a worm 72 (FIGS. 3 and 4) disposed in the housing 64. The worm 72 connected with each shaft 70 meshes with a pinion 73 which is fixedly connected with a string post 52. The tuning devices 38 and 40 have been broken away in FIG. 3 to expose the worms 72 and pinions 73. The tuning devices 38–48 all have the same construction.

The shafts 70 and worms 72 connected therewith have coincident central axes extending perpendicular to the plane 56. Each of the worms 72 extends through the plane 56. The housings 64 enclose the worms 72 connected with the shafts 70 and the pinions connected with the string posts 52. If desired, the actuator shafts 70 could be a relatively thin inner shaft which is integrally formed with the worm 72 and is enclosed by a separate sleeve.

The main actuators 66 include knobs 74 (FIG. 3) which are fixedly connected to the shafts 70. The knobs 74 could have any desired configuration. For example, the knobs 74 could have configurations corresponding to the configurations disclosed in U.S. Pat. No. 2,771,808; or U.S. Pat. No. 4,643,069; or U.S. Pat. No. 4,735,124; or U.S. Pat. No. 5,728,955.

The tuning devices 38–48 are of the locking type and have locking knobs 78 (FIGS. 3 and 4) which are manually rotatable to move a pin 79 (FIG. 4) in a string post 52 to lock one of the strings 18–28 against movement relative to the string post. The locking knobs 78 and portions of the housings 64 for the tuning devices 38 and 40 have been broken away in FIG. 3. The tuning devices 38–48 all have the same construction as is disclosed in U.S. Pat. No. 4,625,614 issued Dec. 2, 1986 and entitled "Tuning Device". The disclosure in the aforementioned U.S. Pat. No. 4,625,614 is hereby incorporated herein in its entirety by this reference thereto.

If desired, the tuning devices 38–48 could have the same construction as is disclosed in U.S. Pat. No. 4,353,280 issued Oct. 12, 1982 and entitled "Tuning Device". Alternatively, the tuning devices 38–48 could be constructed as disclosed in U.S. Pat. No. 5,728,955 issued Mar. 17, 1998 and entitled "Tuning Device". Of course, the tuning devices 38–48 could have other known constructions if desired.

The general construction of the head portion 16 of the musical instrument 10 is similar to the construction disclosed in U.S. patent application Ser. No. 08/962,990 filed Oct. 31, 1997 by Ronald R. Spercel and Robert J. Sperzel and entitled "Musical Instrument". The foregoing U.S. patent application Ser. No. 08/962,990 is incorporated herein in its entirety by this reference thereto. However, it should be understood that the head portion 16 of the musical instrument 10 could have a different construction if desired. For example, the head portion 16 could be constructed in the manner disclosed in U.S. Pat. No. 5,539,144 or in U.S. Pat. No. 5,728,955.

In accordance with a feature of the present invention, identical detuning actuators 80 (FIG. 3) are provided in association with each of the tuning devices 38–48. The tuning devices 38–48 and detuning actuators 80 cooperate to form an improved apparatus for tensioning the strings 18–28 of the musical instrument 10 and for changing the tension in the strings of the musical instrument by a predetermined amount. By varying the tension in one or more of the strings 18–28 of the musical instrument 10, special effects can be obtained during playing of the musical instrument.

The detuning actuators 80 have the same construction and are connected with ends of the tuning devices 38–48 opposite from the main actuators 66. Thus, the main actuators 66 for the tuning device 38 is fixedly connected with the right end (as viewed in FIG. 3) of the worm 72. The detuning actuator 80 is connected with the left end (as viewed in FIG. 3) of the worm 72. The detuning actuator 80, worm 72, and main actuator 66 have coincident central axes.

Although a detuning actuator 80 has been illustrated in FIG. 3 in association with each of the tuning devices 38–48, a detuning actuator may be associated with only some of the tuning devices. For example, detuning actuators may be associated with just the tuning devices 38, 42 and 46 or with just the tuning devices 40, 44 and 48. Alternatively, a detuning actuator 80 may be associated with only one or two of the tuning devices 38–40. Thus, a pair of detuning actuators 80 could be associated with just the tuning devices 38 and 40 or a single detuning actuator could be associated with just the tuning device 38.

Head Portion—Configuration

The head portion 16 has a linear edge portion 82 and a nonlinear edge portion 84 (FIGS. 2 and 3). The linear and nonlinear edge portions 82 and 84 extend between the front a side surface 36 (FIG. 2) and rear side surface 58 (FIG. 3) of the head portion 16. The linear and nonlinear edge portions 82 and 84 have a length corresponding to the length of the linear array of string posts 52 for the tuning devices 38–48.

The linear edge portion 82 extends parallel to the plane 56 containing the central axes of the string posts 52. The shafts 70 of the tuning devices 38, 42 and 46 extend perpendicular to the linear edge portion 82. The knobs 74 for the tuning devices 38, 42 and 46 are disposed in a linear array along the linear edge portion 82. Each of the shafts 70 for the tuning devices 38, 42 and 46 has the same length. Therefore, the knobs 74 for the tuning devices 38, 42 and 46 are disposed the same distance from the linear edge portion 82.

The nonlinear edge portion 84 has an arcuately curving configuration. The arcuately curving configuration of the nonlinear edge portion 84 defines a pair of arcuate recesses 88 and 90 (FIGS. 2 and 3). The strings 26 and 28 span the arcuate recess 88 (FIG. 2). This enables the strings 26 and 28 to be plucked at the arcuate recess 88 to provide special effects during playing of the musical instrument 10.

The knobs 74 for the tuning devices 40, 44 and 48 are disposed adjacent to the recesses 88 and 90. During rotation of the knobs 74 for the tuning devices 40, 44 and 48, the knobs move in the recesses 88 or 90. Thus, during rotation of the knob 74 to operate the tuning device 40 to vary the tension in the string 20 (FIG. 2), the knob moves in the arcuate recess 88. Similarly, during manual rotation of the actuator knob 74 for either the tuning device 44 or 48 to vary the tension in the string 24 or 28, the knob moves in the arcuate recess 90. As was previously mentioned, the knobs 74 could have any desired configuration. The head portion 16 of the musical instrument 10 may have a configuration which is different than the illustrated configuration.

Tuning Device Orientation

The main actuators 66 for adjacent tuning devices 38–48 extend in opposite directions from the linear array of string posts (FIGS. 1 and 2). Thus, the main actuators 66 (FIGS. 2 and 3) for the tuning devices 38, 42 and 46 extend across the linear edge portion 82. The main actuators 66 for the tuning devices 40, 44 and 48 extend across the nonlinear edge portion 84.

By having the main actuators 66 for the tuning devices 38, 42, and 46 extend in a direction opposite from the main actuators 66 for the tuning devices 40, 44, and 48, spacing between the knobs 74 for the tuning devices 38–48 is maximized (FIGS. 1–3). This provides room for engagement of any one of the knobs 74 by the hand of a person playing the instrument 20. If the main actuators 66 all extended in the same direction from the tuning devices 38–48, there would be half as much spacing between the knobs 74 for the tuning devices. The relatively large spaces provided between the actuator knobs 74 of the tuning devices 38–48 of FIGS. 1 and 2 enables a musician to rotate any one of the knobs without engaging an adjacent knob and accidentally changing the tension for an associated string.

Different Length Actuators

The main actuators 66 for the tuning devices 40 and 44 (FIG. 3) are longer than the main actuators for the tuning devices 38, 42, 46 and 48. The relatively long length of the main actuators 66 for the tuning devices 40 and 44 enables the knobs 74 for these tuning devices to be disposed in the arcuate recesses 88 and 90 during rotation of the actuator knobs. In addition, the relatively long length of the main actuators 66 for the tuning devices 40 and 44 enables the head portion 16 to project a substantial distance toward the left (as viewed in FIG. 3) from the plane 56 through the linear array of string posts 52 (FIG. 2). This enables the material of the head portion (wood) to have sufficient rigidity to support the tuning devices 38–48.

In the illustrated embodiment of the invention, the actuators 66 for the tuning devices 40 and 44 have the same length. However, it is contemplated that it may be desired to construct the main actuators 66 for the tuning devices 40 and 44 with different lengths. Thus, the main actuator 66 for the tuning device 40 could be longer than the main actuator 66 for the tuning device 44. In the embodiment of the invention illustrated in FIG. 3, the main actuator 66 for the tuning device 48 has the same length as the main actuators 66 for the tuning devices 38, 42 and 46. However, it is contemplated that the main actuator 66 for the tuning device 48 could be longer than the main actuators 66 for the tuning devices 38, 42 and 46 if desired.

Detuning Actuator

In accordance with a feature of the present invention, a detuning actuator 80 (FIGS. 3, 5, 6, 7, 8 and 9) is associated with the tuning device 38. The detuning actuator 80 is manually operable to rotate the worm 72 (FIG. 3) through a predetermined distance relative to the housing 64. Rotation of the worm 72 relative to the housing 64 by the detuning actuator 80 rotates the pinion 73 connected with the string post 52 (FIG. 4) through a predetermined distance. This rotation of the string post 52 changes the tension in the string 18 from a first or initial tension by a predetermined amount.

Although the detuning actuator 80 could be utilized to increase the tension in the string 18, it is believed it will be preferred to utilize the detuning actuator 80 to decreases the tension in the string 18. Reducing the tension in the string 18 changes the pitch of the string. Changing the pitch of the string 18 during playing of the musical instrument 10 enables special effects to be achieved.

Since manual actuation of the detuning actuator 80 results in a predetermined change in the tension in the string 18, operation of the detuning actuator results in a predictable change in the pitch of the string 18 and in predictable special effects during playing of the musical instrument 10. After the detuning actuator 80 has been manually operated to change the tension in the string 18 from the initial tension, the detuning actuator can be manually operated to return the tension in the string to the initial tension. The detuning actuator 80 can be repeatedly operated to repeatedly decrease and increase the tension in the string 18 by the same predetermined amount.

Figure 9:
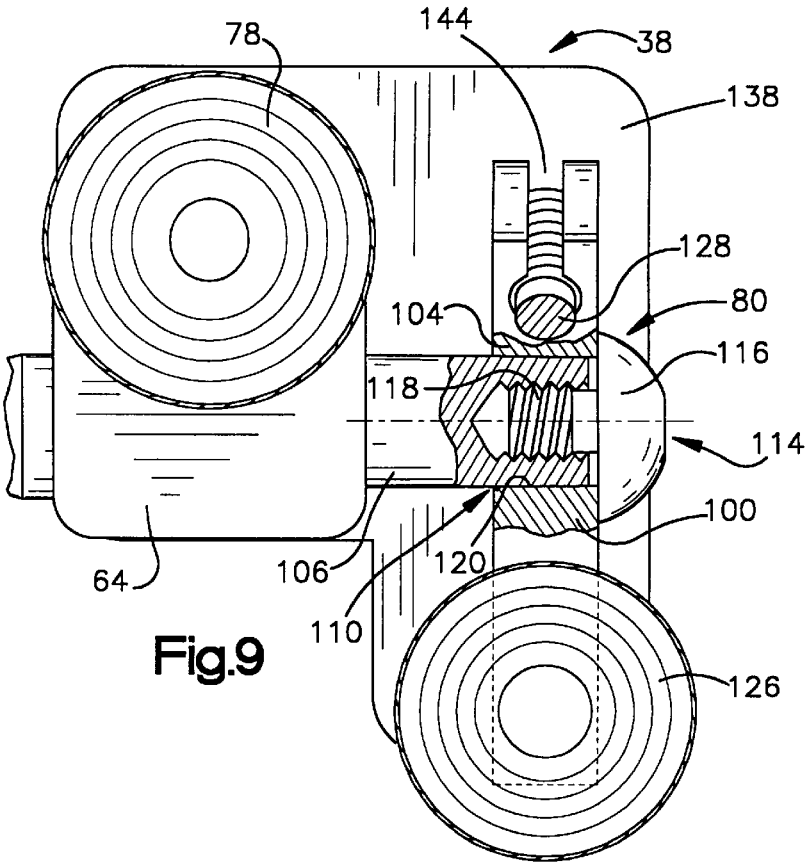
FIG. 9 is an enlarged fragmentary sectional view illustrating a coupling disposed between the tuning device and detuning actuator of FIG. 7.

The detuning actuator 80 includes a pair of arms 100 and 102 which are fixedly interconnected by a body portion 104 (FIG. 6). The arms 100 and 102 are integrally formed as one piece with the body portion 104. A shaft 106 is integrally formed as one piece with the worm 72 (FIG. 3). The shaft 106 extends outward from the housing 64 into the body portion 104 (FIG. 5) of the detuning actuator 80. The shaft 106 is connected with the detuning actuator 80 through a coupling 110 (FIG. 9).

The coupling 110 enables the shaft 106 to rotate relative to the detuning actuator 80 during operation of the tuning device 38 to establish the initial or first tension in the string 18. The coupling 110 is effective to transmit force from the detuning actuator 80 through the worm 72 (FIGS. 3 and 4) in the tuning device 38 upon manual operation of the detuning actuator 80 from the initial or unoperated condition of FIGS. 5 and 6 to the operated condition of FIGS. 7 and 8. The force transmitted from the detuning actuator 80 through the coupling 110 to the shaft 106 is effective to rotate the worm 72. This rotation of the worm 72 results in rotation of the pinion 73 and string post 52 to reduce the tension in the string 18.

In the illustrated embodiment of the invention, the coupling 110 (FIG. 9) is a friction clutch. The shaft 106 has an axially tapering configuration. Therefore, the shaft 106 extends rightward (as viewed in FIG. 9) from a relatively large diameter portion adjacent to the housing 64 to a relatively small diameter end portion which is engaged by a retaining screw 114.

The retaining screw 114 has a head end portion 116 which engages the body portion 104 of the detuning actuator 80. An externally threaded shank portion 118 of the screw 114 engages an internally threaded opening formed in the shaft 106. The body portion 104 of the detuning actuator 80 has an axially tapered opening 120. The opening 120 tapers rightward (as viewed in FIG. 9) from a large diameter to a small diameter adjacent to the head end portion 116 of the screw 114.

The retaining screw 114 presses the body portion 104 of the detuning actuator 80 onto the shaft 106. The force applied to the body portion 104 of the detuning actuator 80 is effective to enable friction between the axially tapered shaft 106 and axially tapered opening 120 to transmit force from the detuning actuator 80 to the shaft 106. Therefore, the shaft 106 is rotated through the same distance upon operation of the detuning actuator 80 from either the initial or unactuated condition to the actuated condition or upon operation of the detuning actuator from the actuated condition back to the unactuated condition.

The friction between the shaft 106 and opening 120 in the body portion 104 of the detuning actuator 80 can be overcome by rotation of the knob 74 (FIG. 5) of the main actuator 66. Therefore, upon rotation of the main actuator 66 to initially obtain a desired tension in the string 18, rotation of the knob 74 results in rotation of the worm 72 and shaft 106. This rotation of the worm 72 is effective to operate the detuning device 80 to the unactuated condition of FIGS. 5 and 6. Continued rotation of the knob 74 of the main actuator 66 to further tighten the string 18 results in the occurrence of slippage at the coupling 110. Therefore, the shaft 106 and worm 72 continue to rotate with the knob 74 of the main actuator 66. This rotates the string post 52 while the detuning actuator arms 100 and 102 remain stationary in the initial or unactuated condition of FIGS. 5 and 6.

Although the coupling 110 is a friction clutch, other types of couplings could be utilized. For example, the coupling 110 could be an overrunning clutch. The coupling 110 is effective to allow relative rotation to occur between the shaft 106 and the detuning actuator 80 during initial adjustment of the tension in the string 18 and to subsequently transmit force from the detuning actuator 80 to the shaft 106 to effect a change in the tension in the string 18.

Adjustable stop screws 126 and 128 (FIG. 6) are connected with the arms 100 and 102. The stop screws 126 and 128 have stop surfaces 132 and 134 (FIGS. 6 and 8) which are engageable with a stop plate 138. The stop plate 138 is fixedly connected with the head end portion 16 (FIG. 3) of the musical instrument 10 and with the housing 64 of the tuning device 38.

Figure 8:
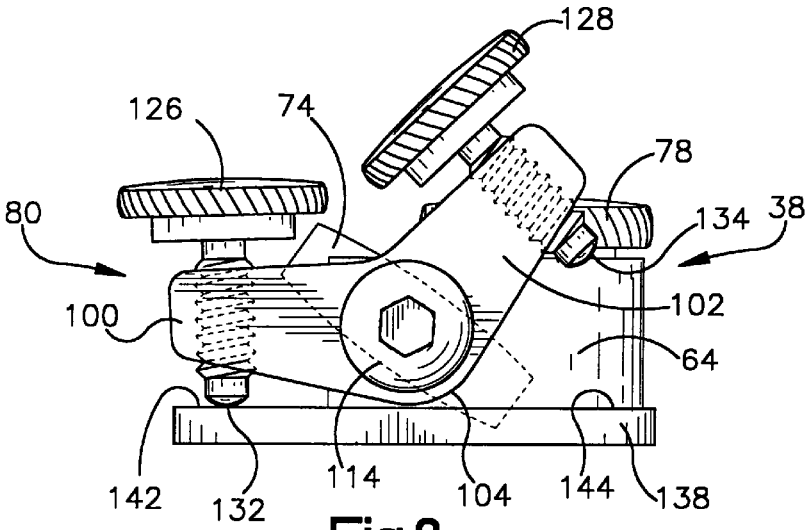
FIG. 8 is an end view, taken generally along the line 8—8 of FIG. 7, illustrating the detuning actuator after the detuning actuator has been operated to change the tension in a string of the musical instrument.

The stop plate 138 has a stop surface area 142 (FIGS. 6 and 8) which is engaged by the stop surface 132 on the stop screw 126 when the detuning actuator 80 is in the actuated condition of FIG. 8. When the tuning actuator 80 is in the unactuated condition of FIG. 6, the stop surface 134 on the stop screw 128 engages a stop surface area 144 (FIG. 6) on the stop plate 138.

The stop screws 126 and 128 cooperate with the arms 100 and 102 to limit the extent to which the shaft 106 is rotated by operation of the detuning actuator 80. Thus, when the detuning actuator is operated from the unactuated condition of FIGS. 5 and 6 to the actuated condition of FIGS. 7 and 8, the stop surface 132 connected with the arm 100 moves into engagement with the stop surface area 142 on the stop plate 138 to limit the extent of rotation of the shaft 106. When the detuning actuator 80 is to be operated from the actuated condition of FIGS. 7 and 8 back to the unactuated condition of FIGS. 5 and 6, the stop surface 134 connected with the arm 102 moves into engagement with the stop surface area 144 on the stop plate 138 to limit the extent of rotation of the shaft 106.

In the illustrated embodiment of the invention, the stop surface areas 142 and 144 are disposed on a single stop plate 138 which is connected with the head end portion 16 of the musical instrument 10. However, it is contemplated that the stop surface areas 142 and 144 could be provided on separate stop members. Thus, the stop surface area 142 could be disposed on a circular stop button which is connected to the head end portion 16 of the musical instrument 10 at a location in the path of movement of the stop surface 132 on the stop screw 126. Similarly, the stop surface area 144 could be provided on a second circular button which is connected with the head end portion 16 of the musical instrument 10 at a location in the path of movement of the stop surface 134 on the stop screw 128.

Although only the detuning actuator 80 for the tuning device 38 is illustrated in FIGS. 5–9, it should be understood that the detuning actuators for all of the tuning devices 38–48 (FIG. 3) have the same construction. If the tuning devices 38–48 were mounted in the same orientation on the head portion 16 of the musical instrument 10, the detuning actuators 80 would be mounted in the same orientation on the head portion 16 of the musical instrument. If the tuning devices 38–48 are mounted in the same orientation on the head portion 16 of the musical instrument 10, for example, with all of the main actuators 66 extending from the linear edge portion 82 (FIGS. 2 and 3), the shafts 106 interconnecting the detuning actuators 80 and the worm gears 72 could have different lengths to enable the detuning actuators to be offset from each other.

Operation

When the musical instrument 10 is to be played, the tuning device 38 is operated to establish an initial tension in the string 18 (FIGS. 2 and 4). To establish an initial tension in the string 18, the knob 74 of the main actuator 66 (FIG. 3) is rotated to rotate the worm 72. Upon initial rotation of the worm 72 and shaft 106, the detuning actuator 80 is operated to the unactuated condition of FIGS. 5 and 6. This results in the stop surface 134 on the screw 128 engaging the stop plate 138 to block further rotation of the detuning actuator 80.

Continued rotation of the knob 74 of the main actuator 66 in the same direction results in slippage at the coupling 110 between the shaft 106 and detuning actuator 80. Therefore, the continued rotation of the knob 74 is effective to rotate the worm 72, the pinion 73 and string post 52. The continued rotation of the string post 52 tightens the string 18 while the detuning actuator 80 remains stationary in the actuated condition of FIGS. 5 and 6.

When the desired initial tension has been obtained in the string 18, rotation of the actuator knob 74 is interrupted. At this time, the detuning actuator 80 will be in the initial or unactuated condition of FIGS. 5 and 6.

During subsequent playing of the musical instrument 10, a musician may wish to change the tension in the string 18. To effect a predetermined change in the tension in the string 18, the musician manually operates the detuning actuator 80. Thus, the musician applies manual force against the stop screw 126 to pivot the arms 100 and 102 in a counterclockwise direction (as viewed in FIG. 6) about the coincident central axes of the shaft 106 and worm 72. Rotational force is transmitted through the coupling 110 from the body portion 104 of the detuning actuator 80 to the shaft 106. This rotation of the shaft 106 is effective to rotate the worm 72 (FIG. 3) and pinion 73. Since the pinion 73 is fixedly connected with the string post 52, rotation of the pinion 73 results in rotation of the string post and a change in the tension in the string 18.

When the stop surface 132 connected with the arm 100 engages the stop surface area 142 on the stop plate 138 (FIG. 8) further rotational movement of the arms 100 and 102 is blocked. Therefore, rotation of the shaft 106 is interrupted. When this occurs, the pinion 73 and string post 52 will have been rotated through a predetermined arcuate distance to effect a predetermined reduction in the tension in the string 18. Since a predetermined change has occurred in the tension of the string 18, the musician playing the instrument 10 can predict the resulting change in the sound of the instrument.

Figure 5:
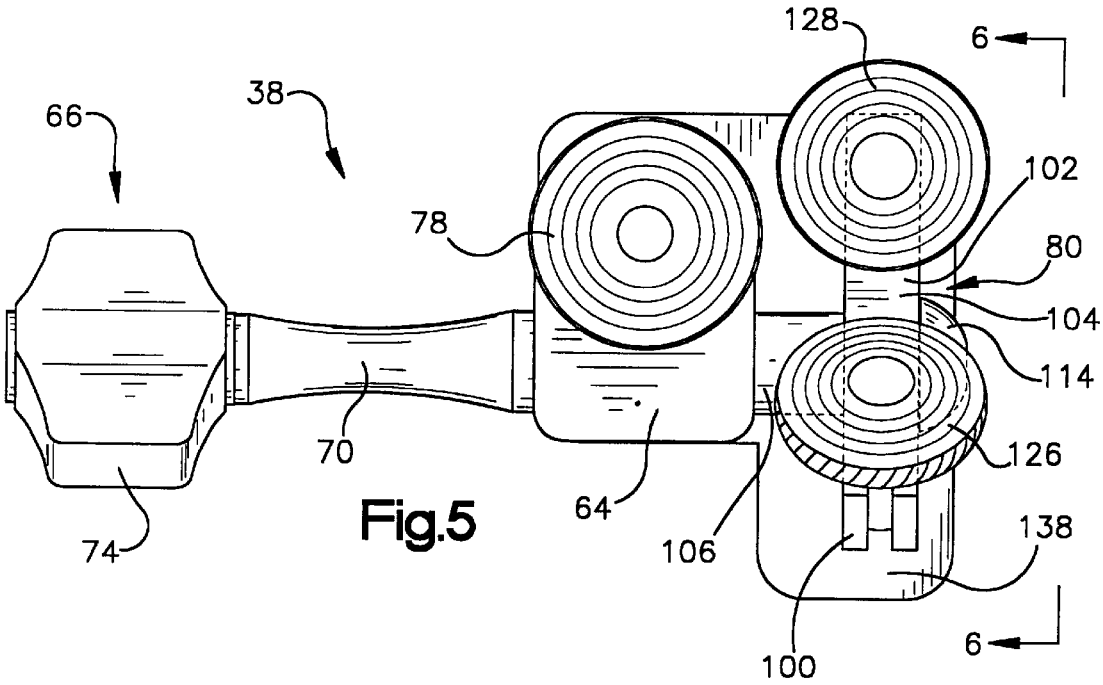
FIG. 5 is an enlarged plan view of one of the tuning devices of FIG. 3 and an associated detuning actuator.
Figure 6:
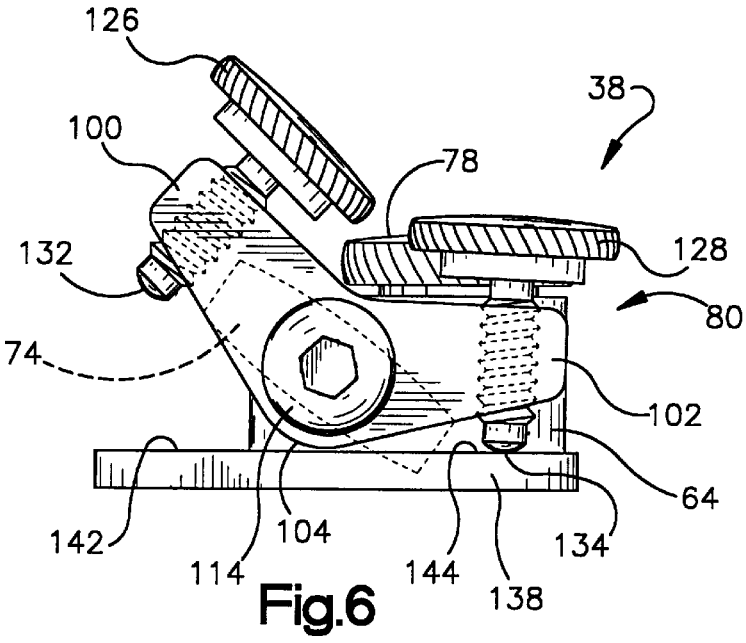
Figure 7:
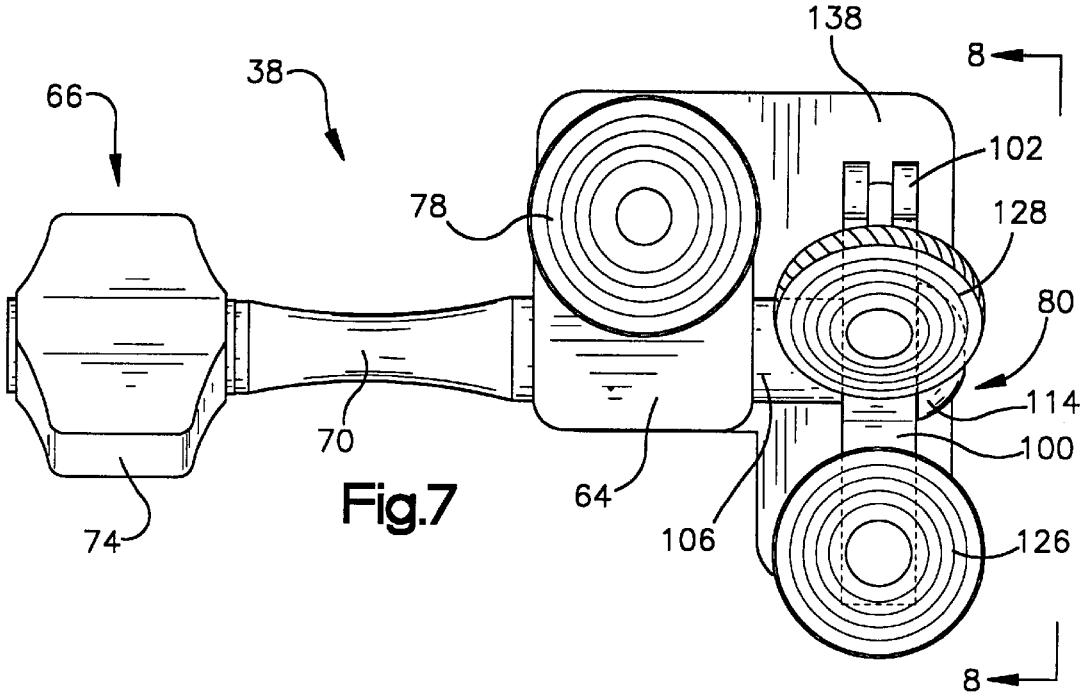
FIG. 7 is a plan view, generally similar to FIG. 5, of a tuning device and detuning actuator after the detuning actuator has been manually operated to change the tension in a string of the musical instrument of FIG. 1.

When a musician desires to have the tension in the string 18 returned to the initial tension, the detuning actuator 80 is manually operated from the actuated condition of FIGS. 7 and 8 to the unactuated condition of FIGS. 5 and 6. To operate the detuning actuator 80 to the unactuated condition, the musician manually applies force against the stop screw 128. This effects rotation of the arms 100 and 102 in a clockwise direction from the actuated condition of FIG. 8 toward the unactuated condition of FIG. 6. As this occurs, the direction of rotation of the shaft 106 and worm 72 is reversed to reverse the direction of rotation of the pinion 73 and string post 52. This results in the tension in the string 18 being increased to the initial tension in the string.

When the stop surface 134 connected with the arm 102 engages the stop surface area 144 (FIG. 6), the rotational movement of the arms 100 and 102 and shaft 106 is interrupted. At this time, the initial tension will have been re-established in the string 18.

Detuning Actuator—Second Embodiment

Figure 10:
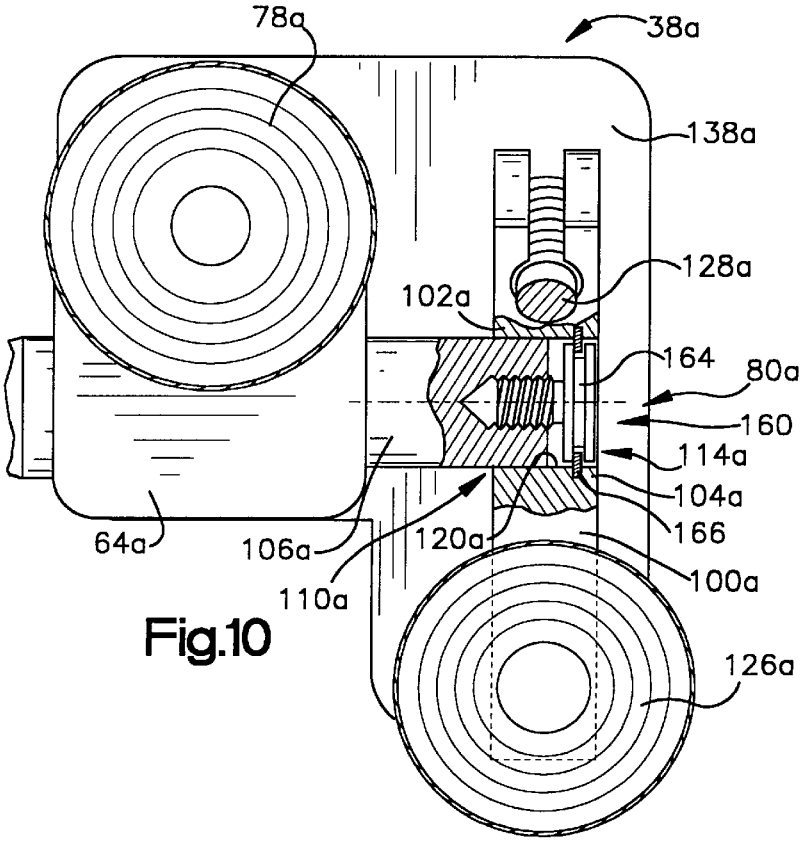
FIG. 10 is an enlarged fragmentary sectional view, generally similar to FIG. 9, of a second embodiment of the detuning actuator.

In the embodiment of the invention illustrated in FIGS. 1—9, a retaining screw 114 (FIG. 9) is used to connect the detuning actuator 80 with the shaft 106. Due to the interference fit between the axially tapering surfaces on the shaft 106 and body of the detuning actuator 80, difficulty may be encountered in adjusting the magnitude of the force which is transmitted through the friction clutch 110 before slippage occurs between the body portion 104 of the detuning actuator 80 and the shaft 106. In the embodiment of the invention illustrated in FIG. 10, the connection between the detuning actuator and the worm shaft is adjustable to either increase or decrease the friction force transmitted through the coupling between the detuning actuator and worm shaft. Since the embodiment of the invention illustrated in FIG. 10 is similar to the embodiment of the invention illustrated in FIGS. 1–9, similar components will be identified with similar numerals, the suffix letter "a" being added to the numerals of FIG. 10 to avoid confusion.

The tuning device 38 includes a housing 64*a* which encloses a worm and pinion corresponding to the worm 72 and pinion 73 of FIG. 3. A locking knob 78*a* is provided to lock a string, corresponding to the string 18 of FIG. 4, against movement relative to a string post.

The tuning device 38*a* includes an axially tapered shaft 106*a* which is integrally formed as one piece with the worm enclosed by the housing 64*a*. A detuning actuator 80*a* is connected with the shaft 106*a* at a coupling 110*a*. In the illustrated embodiment of the invention, the coupling 110*a* is a friction clutch.

The detuning actuator 80*a* includes a pair of arms 100*a* and 102*a* which are integrally formed as one piece with a body portion 104*a* of the detuning actuator 80*a*. Stop screws 126*a* and 128*a* are connected with the arms 100*a* and 102*a*. The stop screws 126*a* and 128*a* cooperate with a stop plate 138*a* to limit the extent of rotational movement of the arms 100*a* and 102*a*.

In accordance with a feature of this embodiment of the invention, a connector assembly 160 interconnects the detuning actuator 80*a* and the shaft 116*a*. The connector assembly 160 includes a screw 114*a* which engages the shaft 106*a*. An annular groove 164 in the screw 114*a* is connected with the body 104*a* of the detuning actuator 80*a* by an annular washer or C-clip 166. The C-clip 166 engages an annular groove in the body portion 104*a* of the detuning actuator 80*a*.

When the screw 114*a* is rotated in one direction relative to the shaft 106*a*, the screw applies force against the C-clip 166 to pull the detuning actuator 80*a* onto the shaft 106*a*. When the screw 114*a* is rotated in the opposite direction, the screw applies force against the C-clip 166 to push the detuning actuator 80*a* off of the shaft 106*a*. By rotating the screw 114*a*, the force with which the tapered shaft 106*a* engages the tapered opening 120*a* in the body portion 104*a* of the detuning actuator 80*a* can be adjusted.

Conclusion

In view of the foregoing description, it is apparent that the present invention provides a new and improved musical instrument 10 having an improved apparatus 38 and 80 for use in tensioning a string 18 and for changing the tension in the string by a predetermined amount. The apparatus 38 and 80 includes a tuning device 38 for tensioning the string. The tuning device 38 includes a string post 52 and a pinion 73 which is connected with an end of the string post. A worm 73 is disposed in meshing engagement with the pinion 73. A manually rotatable knob 74 is connected with one end portion of the worm 72. Rotation of the knob 74 rotates the worm 72 and imparts rotary motion to the pinion and string post 52 to obtain a desired initial tension in the string of the musical instrument.

A detuning actuator 80 is connected with the worm 72. The detuning actuator 80 is operable to rotate the worm 72 through a predetermined distance to change the tension in the string 18 of the musical instrument 10 from the initial tension by a predetermined amount. A coupling 110 may be used to interconnect the worm 72 and the detuning actuator 80 to enable the worm to rotate relative to the detuning actuator to obtain a first tension in the string. The coupling 110 is effective to transmit force from the detuning actuator 80 to the worm 72 to change the tension in the string 18 of the musical instrument from the initial tension to a second tension.

The head portion 16 of the musical instrument 10 may have a linear edge portion 82 and a nonlinear edge portion 84. The tuning devices 38, 42 and 46 have manually rotatable knobs 74 disposed adjacent to the linear edge portion 82. Other tuning devices 40, 44 and 48 have manually rotatable knobs 74 disposed adjacent to the nonlinear edge portion 84. One or more detuning actuators 80 are mounted on the head portion 16 between the linear and nonlinear edge portions 82 and 84.

Having described the invention, the following is claimed:

1. An apparatus for use in tensioning a string of a musical instrument and for changing the tension in the string of the musical instrument by a predetermined amount, said apparatus comprising a housing, a string post projecting from said housing, said string post being connectable with the string of the musical instrument, a pinion connected with said string post and disposed in said housing, a worm disposed in said housing in meshing engagement with said pinion, a manually rotatable knob connected with a first end portion of said worm for rotating said worm relative to said housing to thereby impart rotary motion to said pinion and string post to obtain a first tension in the string of the musical instrument, and a manually engageable actuator connected with a second end portion of said worm and movable to rotate said worm through a predetermined distance relative to said housing to thereby impart a predetermined amount of rotary motion to said pinion and string post to change the tension in the string of the musical instrument from the first tension by a predetermined amount.

2. An apparatus as set forth in claim 1 further including a friction clutch connected with said actuator and said second end portion of said worm to enable said worm to rotate relative to said actuator during manual rotation of said knob to rotate said worm and obtain the first tension in the string of the musical instrument.

3. An apparatus as set forth in claim 1 wherein said actuator includes a first arm which extends in a first direction and a second arm which extends in a second direction, a stop surface on said first arm being disposed in engagement with a first stop surface area connected with said housing when the first tension is present in the string of the musical instrument, and a stop surface on said second arm being disposed in engagement with a second stop surface area connected with said housing when the tension in the string of the musical instrument has been changed by the predetermined amount, said stop surface on said first arm being spaced from said first stop surface area when said stop surface on said second arm is disposed in engagement with said second stop surface area, said stop surface on said second arm being spaced from said second stop surface area when said stop surface on said first arm is disposed in engagement with said first stop surface area.

4. An apparatus as set forth in claim 1 wherein said worm and said actuator are coupled together by a coupling which enables said worm to be rotated in a first direction relative to said actuator under the influence of force transmitted from said knob to said worm and which enables said worm to be rotated in a second direction under the influence of force transmitted from said actuator to said worm.

5. An apparatus as set forth in claim 1 further including a first shaft integrally formed as one piece with said worm and extending outward from the first end portion of said worm, said knob being connected with said first shaft, and a second shaft integrally formed as one piece with said worm and extending outward from the second end portion of said worm, said actuator being connected with said second shaft.

6. An apparatus as set forth in claim 5 further including a screw member rotatably mounted on said actuator, said screw member being rotatable in a first direction relative to said second shaft to provide force urging said actuator into engagement with said second shaft, said screw member being rotatable in a second direction relative to said second shaft to provide force urging said actuator out of engagement with said second shaft.

7. An apparatus for use in tensioning a string of a musical instrument and for changing the tension in the string of the musical instrument by a predetermined amount, said apparatus comprising a string post connectable with the string of the musical instrument, a pinion connected with said string post, a worm disposed in meshing engagement with said pinion, said worm having a central axis about which said worm is rotatable to rotate said pinion and string post, an actuator, and a coupling interconnecting said worm and said actuator to enable said worm to rotate relative to said actuator about the central axis of said worm to obtain a first tension in the string of the musical instrument and to transmit force from said actuator to said worm to rotate said worm about its central axis to thereby rotate said pinion and string post to change the tension in the string of the musical instrument from the first tension to a second tension.

8. An apparatus as set forth in claim 7 wherein said coupling includes a first surface which is connected with said worm and a second surface which is connected with said actuator and is disposed in engagement with said first surface, said first surface being rotatable with said worm relative to said second surface during rotation of said worm to obtain the first tension in the string of the musical instrument, said first and second surfaces being rotatable together during transmission of force from said actuator to said worm to change the tension in the string of the musical instrument.

9. An apparatus as set forth in claim 7 wherein said actuator is manually rotatable about the central axis of said worm.

10. An apparatus as set forth in claim 7 further including a knob which is connected with said worm and is manually rotatable to cause rotation of said worm and slippage of said coupling during rotation of said worm relative to said actuator to obtain a first tension in the string of the musical instrument.

11. An apparatus as set forth in claim 7 wherein said actuator includes a first arm which extends in a first direction and a second arm which extends in a second direction, a stop surface on said first arm being engageable with a first stop surface area when the first tension is present in the string of the musical instrument, and a stop surface on said second arm being engageable with a second stop surface area when the tension in the string of the musical instrument has been changed from the first tension to the second tension.

12. An apparatus for use in tensioning a string of a musical instrument and for changing the tension in the string of the musical instrument by a predetermined amount, said apparatus comprising a string post connectable with the string of the musical instrument, a pinion connected with said string post, a worm disposed in meshing engagement with said pinion, said worm having a central axis about which said worm is rotatable to rotate said pinion and string post, a first arm connected with said worm and extending in a first direction transverse to the central axis of said worm, a second arm connected with said worm and extending in a second direction transverse to the central axis of said worm, a stop surface on said first arm being disposed in engagement with a first stop surface area when a first tension is present in the string of the musical instrument, and a stop surface on said second arm being disposed in engagement with a second stop surface area when the tension in the string of the musical instrument has been changed from the first tension to the second tension.

13. A musical instrument comprising a body portion, a neck portion connected with and extending from said body portion, a head portion connected with said neck portion, said head portion having a front side and a rear side, a plurality of strings which are connected with said body portion and extend along neck portion to said head portion, a plurality of mechanisms for tensioning the strings, said plurality of mechanisms include a plurality of string posts, each of said strings of said plurality of strings being connected with one of said string posts at a location adjacent to said front side of said head portion, each of said string posts having a central axis which extends transverse to said front and rear sides of said head portion, said central axes of said string posts being disposed in a plane which extends transverse to said front and rear sides of said head portion, each of said mechanisms including a knob which is manually rotatable to operate one of said mechanisms to obtain an initial tension in one of said strings, a first plurality of said knobs extend in a first direction from a first group of said string posts and a second plurality of said knobs extend in a second direction from a second group of string posts, and a plurality of manually engageable actuators each of which is connected with one of said mechanisms, each of said manually engageable actuators being movable to actuate one of said mechanisms to change the tension in one of said strings from the initial tension by a predetermined amount.

14. A musical instrument as set forth in claim 13 wherein each of said mechanisms is at least partially disposed on said rear side of said head portion, each of said string posts extends through said head portion from said rear side of said head portion to said front side of said head portion, each of said actuators being disposed adjacent to said rear side of said head portion.

15. A stringed musical instrument as set forth in claim 13 wherein each of said actuators is rotatable about an axis which is coincident with an axis about which one of said knobs of said plurality of knobs is rotatable.

16. A stringed musical instrument as set forth in claim 13 wherein each of said actuators is disposed adjacent to a side of one of said mechanisms opposite from a side of said one mechanism adjacent to one of said knobs.

17. An apparatus as set forth in claim 13 wherein said knobs of said first plurality of knobs are offset to a first side of the plane in which the central axes of said string posts are disposed, said plurality of actuators include a first plurality of actuators which are offset to a second side of the plane in which the central axes of said string posts are disposed, each actuator of said first plurality of actuators being connected with one of said knobs of said first plurality of knobs, said knobs of said second plurality of knobs are offset to the second side of the plane in which the central axes of said string posts are disposed, said plurality of actuators include a second plurality of actuators which are offset to the first side of the plane in which the central axes of said string posts are disposed, each actuator of said second plurality of actuators being connected with one of said knobs of said second plurality of knobs.

18. A musical instrument as set forth in claim 13 wherein each of said mechanisms includes a pinion connected with one of said string posts and a worm disposed in meshing engagement with said pinion, said worm in each of said mechanisms extends through the plane in which the central axes of said string posts are disposed.

19. An apparatus for use in tensioning a string of a musical instrument and for changing the tension in the string of the musical instrument by a predetermined amount, said apparatus comprising a string post connectable with the string of the musical instrument, a pinion connected with said string post, a worm disposed in engagement with said pinion, said worm having a central axis about which said worm is rotatable to rotate said pinion, a manually rotatable knob connected with a first end portion of said worm and rotatable about the central axis of said worm, and a manually rotatable actuator connected with a second end portion of said worm and rotatable through a predetermined distance about the central axis of said worm to impart a predetermined amount of rotary motion to said pinion and string post to change the tension in the string of the musical instrument by a predetermined amount.

20. An apparatus as set forth in claim 19 further including coupling means interconnecting said actuator and said second end portion of said worm for enabling said worm to rotate in one direction relative to said actuator under the influence of force transmitted from said knob to said worm and for enabling said actuator to rotate said worm in a direction opposite to said one direction under the influence of force transmitted from said actuator to said worm.

21. An apparatus as set forth in claim 19 wherein said actuator includes a pair of arms which are connected with said second end portion of said worm and are rotatable about the central axis of said worm, and stop means for limiting the extent of rotation of said arms.

22. An apparatus as set forth in claim 19 wherein said knob is fixedly connected with the first end portion of said worm for rotation therewith and said actuator is connected with said second end portion of said worm by a coupling which enables relative rotation to occur between said second end portion of said worm and said actuator.

23. An apparatus for use in tensioning a string of a musical instrument and for changing the tension in the string of the musical instrument by a predetermined amount, said apparatus comprising a string post connectable with the string of the musical instrument, a pinion connected with said string post, a worm disposed in meshing engagement with said pinion, a manually rotatable input member connected with said worm, a pair of arms, and a coupling connecting said pair of arms with said worm, said coupling being effective to enable said worm to rotate relative to said pair of arms when said pair of arms are in a first position, said coupling being operable to effect rotation of said worm upon movement of said pair of arms to a second position.

24. An apparatus as set forth in claim 23 wherein said pair of arms are fixedly interconnected.

25. An apparatus as set forth in claim 23 wherein said pair of arms are rotatable about a central axis of said worm.

26. An apparatus for use in tensioning a string of a musical instrument and for changing the tension in the string of the musical instrument by a predetermined amount, said apparatus comprising a housing, a string post projecting from said housing, said string post being connectable with the string of the musical instrument, a pinion connected with said string post and disposed in said housing, a worm disposed in said housing in meshing engagement with said pinion, a first shaft fixedly connected to said worm and extending in a first direction from said worm, a second shaft fixedly connected to said worm and extending in a second direction from said worm, said second direction being opposite to said first direction, a manually rotatable knob connected to said first shaft and rotatable with said first shaft and said worm relative to said housing to rotate said worm relative to said housing to thereby impart rotary motion to said pinion and string post to obtain a first tension in the string of the musical instrument, and a manually engageable actuator connected to said second shaft and rotatable with said second shaft and said worm relative to said housing to rotate said worm through a predetermined distance relative to said housing to thereby impart a predetermined amount of rotary motion to said pinion and string post to change the tension in the string of the musical instrument from the first tension by a predetermined amount.

27. An apparatus as set forth in claim 26 further including a clutch connected with said actuator and said second shaft to enable said first and second shafts and said worm to rotate together relative to said actuator during manual rotation of said knob to obtain the first tension in the string of the musical instrument.

28. An apparatus as set forth in claim 26 wherein said actuator includes a first arm which extends in a first direction from said second shaft and a second arm which extends in a second direction from said second shaft, a stop surface on said first arm being disposed in engagement with a first stop surface area fixedly connected with said housing when the first tension is present in the string of the musical instrument, and a stop surface on said second arm being disposed in engagement with a second stop surface area fixedly connected with said housing when the tension in the string of the musical instrument has been changed by the predetermined amount, said stop surface on said first arm being spaced from said first stop surface area when said stop surface on said second arm is disposed in engagement with said second stop surface area, said stop surface on said second arm being spaced from said second stop surface area when said stop surface on said first arm is disposed in engagement with said first stop surface area, said first stop surface area being offset to a first side of an axis about which said worm is rotatable, said second surface area being offset to a second side of the axis about which said worm is rotatable.

29. An apparatus as set forth in claim 26 wherein said worm and said actuator are coupled together by a coupling which enables said worm to be rotated in a first direction relative to said actuator under the influence of force transmitted from said knob through said first shaft to said worm and which enables said worm to be rotated in a second direction under the influence of force transmitted from said actuator through said second shaft to said worm.

30. An apparatus as set forth in claim 26 wherein said first shaft is integrally formed as one piece with said worm and has a central axis which is coincident with a central axis of said worm, said second shaft is integrally formed as one piece with said worm and has a central axis which is coincident with the central axis of said worm.

31. An apparatus as set forth in claim 26 further including a screw member rotatably mounted on said actuator and disposed in threaded engagement with said second shaft, said screw member being rotatable in a first direction relative to said second shaft to provide force urging said actuator into engagement with said second shaft, said screw member being rotatable in a second direction relative to said second shaft to provide force urging said actuator out of engagement with said second shaft.

32. An apparatus for use in tensioning a string of a musical instrument and for changing the tension in the string of the musical instrument by a predetermined amount, said apparatus comprising a housing, a string post projecting from said housing, said string post being connectable with the string of the musical instrument, said string post being rotatable about a first axis, a pinion connected with said string post and disposed in said housing, said pinion being rotatable about said first axis with said string post, a worm disposed in said housing in meshing engagement with said pinion, said worm being rotatable about a second axis which extends transverse to said first axis, a manually rotatable knob connected with a first end portion of said worm and rotatable about said second axis to rotate said worm relative to said housing to thereby impart rotary motion to said pinion and string post to obtain a first tension in the string of the musical instrument, and a manually engageable actuator connected with a second end portion of said worm and rotatable about said second axis to rotate said worm about said second axis through a predetermined distance relative to said housing to thereby impart a predetermined amount of rotary motion to said pinion and string post about said first axis to change the tension in the string of the musical instrument from the first tension by a predetermined amount.

33. An apparatus as set forth in claim 32 further including a clutch connected with said actuator and said second end portion of said worm to enable said worm to rotate about said second axis relative to said actuator during manual rotation of said knob about said second axis to rotate said worm about said second axis and to rotate said pinion and string post about said first axis to obtain the first tension in the string of the musical instrument.

34. An apparatus as set forth in claim 33 wherein said clutch has a central axis which is coincident with said second axis.

35. An apparatus as set forth in claim 33 wherein said clutch includes a first friction surface fixedly connected with said worm and a second friction surface fixedly connected with said actuator and disposed in engagement with said first friction surface, said first friction surface being rotatable with said worm about said second axis, said second friction surface being rotatable with said actuator about said second axis.

36. An apparatus as set forth in claim 32 wherein said actuator includes first and second arms which extend transverse to said second axis, a stop surface on said first arm being disposed in engagement with a first stop surface area connected with said housing when the first tension is present in the string of the musical instrument, and a stop surface on said second arm being disposed in engagement with a second stop surface area connected with said housing when the tension in the string of the musical instrument has been changed by the predetermined amount, said stop surface on said first arm being spaced from said first stop surface area when said stop surface on said second arm is disposed in engagement with said second stop surface area, said stop surface on said second arm being spaced from said second stop surface area when said stop surface on said first arm is disposed in engagement with said first stop surface area.

37. An apparatus as set forth in claim 36 wherein said housing includes a stop plate, said first stop surface area being disposed on said stop plate at a location offset in a first direction from said second axis, said second stop surface area is disposed on said stop plate at a location offset in a second direction from said second axis.

38. An apparatus as set forth in claim 36 wherein said first and second stop surface areas are disposed on stop buttons connected with the musical instrument at locations spaced from said housing.

39. An apparatus as set forth in claim 32 wherein said worm and said actuator are coupled together by a coupling which enables said worm to be rotated relative to said actuator in a first direction about said second axis under the influence of force transmitted from said knob to said worm and which enables said worm to be rotated in a second direction about said second axis under the influence of force transmitted from said actuator to said worm.

40. An apparatus as set forth in claim 32 further including a first shaft integrally formed as one piece with said worm and extending outward from the first end portion of said worm, said knob being connected with said first shaft, and a second shaft integrally formed as one piece with said worm and extending outward from the second end portion of said worm, said actuator being connected with said second shaft, said first and second shafts having central axes which are coincident with said second axis.

41. An apparatus as set forth in claim 40 further including a screw member rotatably mounted on said actuator, said screw member being rotatable relative to said second shaft in a first direction about said second axis to provide force urging said actuator into engagement with said second shaft, said screw member being rotatable relative to said second shaft in a second direction about said second axis to provide force urging said actuator out of engagement with said second shaft.

42. An apparatus for use in tensioning a string of a musical instrument and for changing the tension in the string of the musical instrument by a predetermined amount, said apparatus comprising a string post connectable with the string of the musical instrument, a pinion connected with said string post, a worm disposed in meshing engagement with said pinion, said worm having a central axis about which said worm is rotatable to rotate said pinion and string post, a manually rotatable knob fixedly connected with a first end portion of said worm and manually rotatable to rotate said worm, a manually rotatable actuator, and a coupling interconnecting said worm and said actuator to enable said worm to rotate relative to said actuator about the central axis of said worm to obtain a first tension in the string of the musical instrument and to transmit force from said actuator to said worm to rotate said worm about its central axis to thereby rotate said pinion and string post to change the tension in the string of the musical instrument from the first tension to a second tension, said coupling being connected with a second end portion of said worm opposite from said first end portion of said worm and having a central axis which is coincident with a central axis of said worm.

43. An apparatus as set forth in claim 42 wherein said coupling includes a first surface which is fixedly connected with said worm and a second surface which is fixedly connected with said actuator and is disposed in engagement with said first surface, said first surface being rotatable about the central axis of said worm relative to said second surface during rotation of said worm to obtain the first tension in the string of the musical instrument, said first and second surfaces being rotatable together about the central axis of said worm during transmission of force from said actuator to said worm to change the tension in the string of the musical instrument.

44. An apparatus as set forth in claim 42 wherein said actuator includes a first arm which extends in a first direction from the central axis of said worm and a second arm which extends in a second direction from the central axis of said worm, a stop surface on said first arm being engageable with a first stop surface area when the first tension is present in the string of the musical instrument, and a stop surface on said second arm being engageable with a second stop surface area when the tension in the string of the musical instrument has been changed from the first tension to the second tension.

* * * * *